United States Patent [19]

Okamoto

[11] Patent Number: 5,049,739

[45] Date of Patent: Sep. 17, 1991

[54] PLASMA ION SOURCE MASS SPECTROMETER FOR TRACE ELEMENTS

[75] Inventor: Yukio Okamoto, Sagamihara, Japan

[73] Assignee: Hitachi, Ltd., Tokyo, Japan

[21] Appl. No.: 443,499

[22] Filed: Dec. 1, 1989

[30] Foreign Application Priority Data

Dec. 9, 1988 [JP] Japan ..... 63-309965

[51] Int. Cl.[5] ..... H01J 49/26

[52] U.S. Cl. ..... 250/281; 250/282; 250/244

[58] Field of Search ..... 250/281, 282, 294

[56] References Cited

U.S. PATENT DOCUMENTS

| | | | |
|---|---|---|---|
| 3,944,826 | 3/1976 | Gray | 250/288 |
| 4,037,100 | 7/1977 | Purser | 250/282 |
| 4,099,052 | 7/1978 | McKinney | 250/492.3 |
| 4,489,237 | 12/1984 | Litherland et al. | 250/282 |
| 4,521,687 | 6/1985 | Naito | 250/294 |
| 4,560,879 | 12/1985 | Wu et al. | 250/281 |
| 4,682,026 | 7/1987 | Douglas | 250/281 |
| 4,746,794 | 5/1988 | French et al. | 250/281 |

OTHER PUBLICATIONS

Analyst, vol. 108 (Feb., 1983) pp. 159–165 Alan D. Date.

Spectrochimica Acta, vol. 42B, No. 5 (1987), pp. 705–712 R. D. Sanger and F. L. Fricke.

*Primary Examiner*—Jack I. Berman

*Assistant Examiner*—Kiet T. Nguyen

*Attorney, Agent, or Firm*—Antonelli, Terry, Stout & Kraus

[57] ABSTRACT

A plasma ion source mass spectrometer for trace elements is provided with a plasma generating section, an ion beam generating section, an ion beam focusing section, an ion mass analyzer section and an ion detector section, is further provided with a resonance charge exchange reaction section and an ion energy analyzer section, both sections being disposed between the ion beam focusing section and the ion mass analyzer section and being constructed such that fast disturbing ions contained in the incident ion beam are transformed in the resonance charge exchange reaction section into fast neutral atoms (or molecules) and slow disturbing ion, and such that the fast neutral atoms (or molecules) and the slow disturbing ions described aboved are separated to be removed from the ions to be analyzed.

18 Claims, 3 Drawing Sheets

PLASMA ION SOURCE MASS SPECTROMETER FOR TRACE ELEMENTS

BACKGROUND OF THE INVENTION

The present invention relates to a plasma ion source mass spectrometer for trace elements for realizing a quantitative method for trace elements in fields such as material science, etc., and in particular to means for reducing interference of plasma gas ions with isobaric elements to improve the quantification.

A prior art plasma ion source mass spectrometer for trace elements using high frequency plasma is discussed in Analyst, Vol. 108 (Feb. 1983), pp. 159–165. FIG. 2 shows the outline of this prior art device, in which reference numeral 10 is a high frequency oscillator; 20 is a load coil; 30 is a discharge tube; 40 is plasma gas; 50 is auxiliary gas; 60 is a sample; 70 is plasma; 180 is a sampling cone; 190 is a skimmer; 195 is an ion extraction electrode; 200 is an ion beam; 210 is a photon stopper; 220 is an ion lens system; 140 is a slit; 160 is a mass analyzer (quadrupole type); and 170 is an ion detector (channeltron, etc.).

On the other hand, a prior art device using microwave plasma is discussed in Spectrochimica Acta. Vol. 42B, No. 5 (1987), pp. 705–712. The outline of the construction is identical to that indicated in FIG. 2 except for the difference in the plasma generating section.

By the prior art techniques described above, apart from the plasma gas and the auxiliary gas, argon (Ar: mass number 40) gas is used as a carrier gas for the sample. For this reason a number of molecule peaks due to Ar are formed. Therefore there is a problem that for K (mass, m/z=39), Ca(40), Fe(56), etc., which are isobaric elements, the quantification is worsened because of interference with the molecule peaks of Ar, etc. Although it was studied to use an analyzer having a high resolving power as the mass spectrometer in order to reduce this interference, there were problems that the precision was not remarkably improved because of the strong interference, that the analyzer was expensive, etc. Further, although it is studied also to use He in lieu of Ar, because the consumption of He is large, it is expensive and thus it is not practical.

SUMMARY OF THE INVENTION

The present invention has been done in order to solve the problems described above and the object thereof is to provide means for preventing the lowering of an S/N (signal/noise) ratio due to photons, etc. radiated by the plasma.

In order to achieve the above object, as indicated in FIG. 1 illustrating the principle of the present invention, a fast ion beam 200 (e.g. consisting of a mixture of $A^+$, $B^+$, $C^+$, etc.) extracted from the plasma is subjected to an atomic-molecular reaction in a charge exchange reaction cell 120 inlet: 121, outlet: 122) filled with slow gas 130 (e.g. atoms or molecules of A) ($10^{-3}-7\times10^3$ Pa), thereafter analyzed in energy by means of an energy analyzer (e.g. a 90° electrostatic energy analyzer, etc.), and finally mass-analyzed by means of a mass analyzer.

The charge exchange cell 120 makes fast ions (a mixed beam of e.g. $A^+$, $B^+$, $C^+$, etc.) 200 extracted from the plasma react with slow reaction gas 130 (e.g. A) as follows:

$$A^+(\text{fast}) + A(\text{slow}) \rightarrow A(\text{fast}) + A^+(\text{slow}) \quad (1)$$

$$\left.\begin{array}{l} B^+(\text{fast}) + A(\text{slow}) \rightarrow B(\text{fast}) + A^+(\text{slow}) \\ C^+(\text{fast}) + A(\text{slow}) \rightarrow C(\text{fast}) + A^+(\text{slow}) \end{array}\right\} \quad (2)$$

At this time, the probability with which the reaction (1) takes place is more than 10 to 100 times (when argon (Ar) gas is used as A) as high as the probability with which the reaction (2) takes place (the probability increases with decreasing energy of the fast ions). The charge exchange takes place more easily when the ions and the atoms are of the same kind. That is, the lower the energy exchanged by the collision is i.e. the closer to energy resonance the ions and the atoms are, the more easily the charge exchange takes place. Consequently a fast $A^+$ion is transformed into a fast A atom and on the contrary a slow A atom is transformed into a slow $A^+$ion (a resonance charge exchange reaction).

The beam thus charge-exchanged is introduced into the succeeding electrostatic energy analyzer 150 (e.g., a 90° deflection type, however it is not restricted thereto) (the potential applied to the outer electrode being e.g. $+V_O/2$ and that applied to the inner electrode $-V_O/2$). Since the neutral beam (fast neutral beam A) is not deflected at all in the energy analyzer 150 stated above, it goes straight on through an aperture 151 formed in the outer electrode of the energy analyzer 150 (cf. FIG. 1, in the direction of the incident beam). On the other hand, the ion beam of fast $B^+$, $C^+$, etc. is deflected by the potentials of $\pm V_O/2$ ($V_O$ between the two electrodes) applied to the energy analyzer 150 stated above and pass therethrough to be transferred to the succeeding mass analyzer. The slow ion beam ($A^+$) is deflected strongly by the potentials of $\pm V_O/2$ and is extinguished without being introduced into the mass analyzer.

In this way, among the fast ion beams ($A^+$, $B^+$, $C^+$, etc.), the fast $B^+$, $C^+$, etc. are mass-analyzed and fast $A^+$ions are transformed into fast A atoms and slow $A^+$ions, which are not mass-analyzed. Thus the problem of the interference of the prior art techniques is solved.

That is, in principle, when the gas in the plasma production region and the reaction gas are so chosen that they are same gases, e.g. Ar (argon) gas being used, K and Ca being mixed in the sample ($A^+$corresponding to $Ar^+$, $B^+$to $K^+$, $C^+$ to $Ca^+$, and A to Ar), $K^+$ and $Ca^+$ are detected; $Ar^+$ ions are neutralized to Ar atoms, which are not detected, and $Ar^+$ ions, which are disturbing ions at this time, are removed (decreasing the interference). Further, $N_2$ gas and He gas may be used in lieu of the Ar gas stated above.

Still further, since the charge exchange reaction cell 120 absorbs photons emitted by the plasma and the aperture 151 disposed in the energy analyzer 150 has an effect of making photons pass straight through to remove them, it is possible to reduce the lowering of the S/N ratio due to photons described above. In addition, if the inner surface of the energy analyzer is blackened out by means of conductive material, reflection can be reduced and thus a still greater effect can be obtained.

DESCRIPTION OF THE PREFERRED EMBODIMENTS

Figure 1:
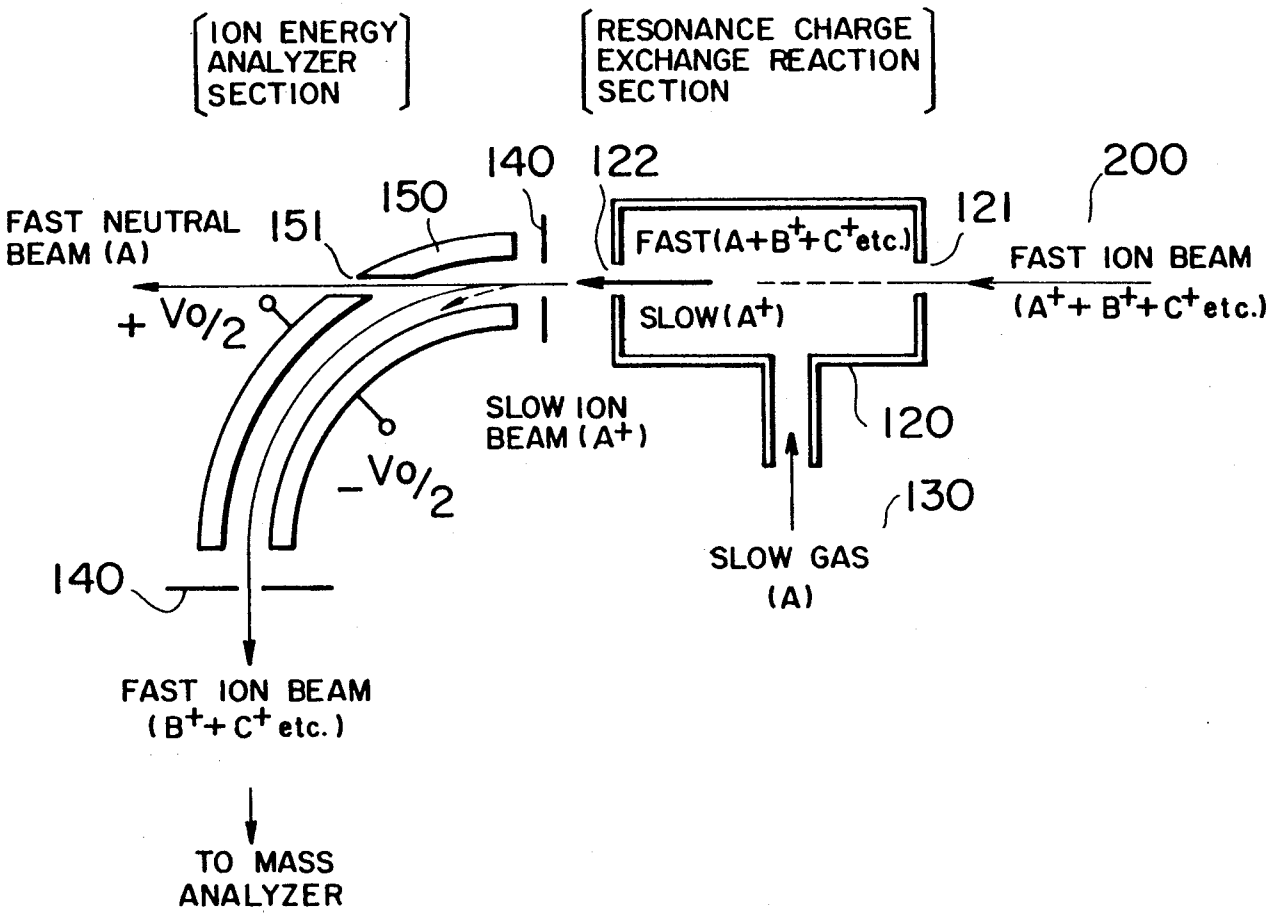
FIG. 1 is a scheme for explaining the principle ,, of the present invention.
Figure 2:
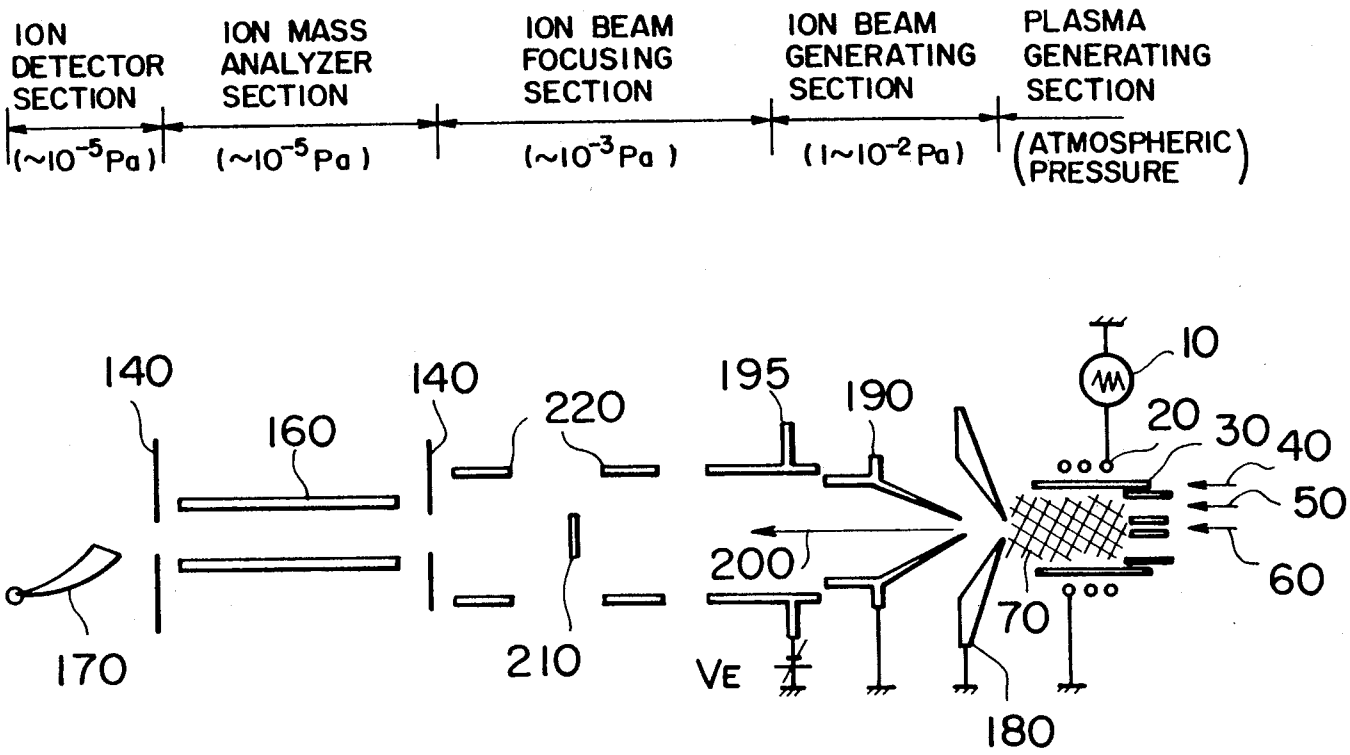
FIG. 2 is a scheme illustrating the construction of a prior art device.

Hereinbelow an embodiment of the present invention will be explained, referring to FIG. 3, in which reference numeral 11 is a microwave plasma torch; 21 is helical coil; 31 is a discharge tube; 41 is cooling gas (air, etc.); 51 is plasma gas (Ar, He, $N_2$, etc.); 60 is a sample (including carrier gas); 70 is plasma; 71 is diffused plasma; 80 is a plasma sampling electrode (made of Ni, etc.); 81 is an orifice formed in the plasma sampling electrode; 90 is an ion extraction electrode (made of Ni, etc.); 91 is an orifice formed in the ion extraction electrode 90; 100 is an ion acceleration electrode (made of SUS-34, etc.); 101 is an orifice formed in the ion acceleration electrode 100; 110 is a lens system (Einzel lens, i.e. unipotential lens, etc.), 120 is a charge exchange reaction cell; 121 and 122 are orifices formed in the cell 120 stated above; 140 is a slit; 150 is an energy analyzer (electrostatic energy analyzer including parallel plate type electrodes having an arbitrary deflection angle, usually 90° deflection); 151 is an orifice formed in the outer electrode of the energy analyzer 150 (which is in accordance with the axis of the injection beam); 160 is a mass analyzer (usually quadrupole type); and 170 an ion detector (channeltron, multiplate, secondary electron multiplier, etc.).

Figure 3:
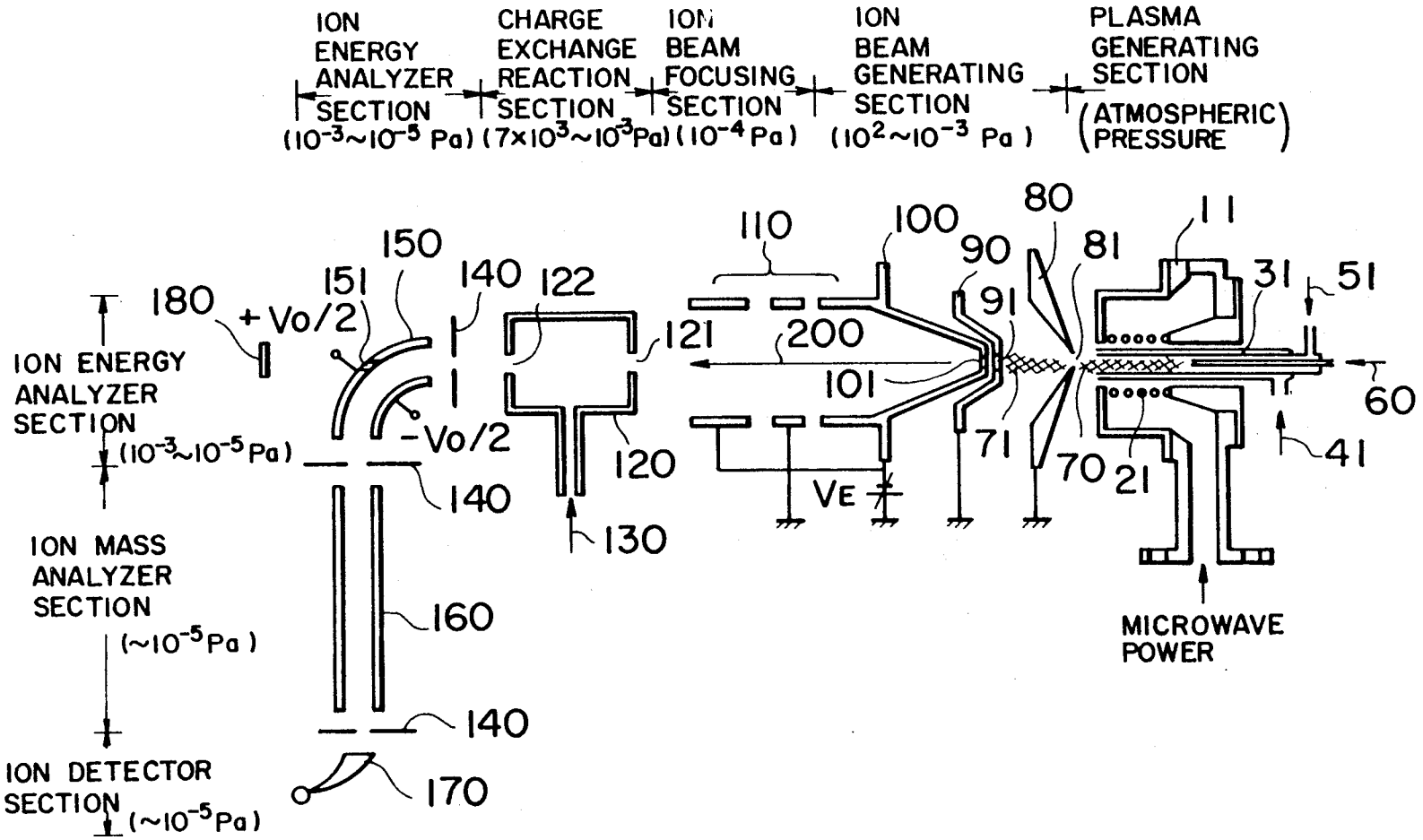
FIG. 3 is a scheme illustrating the outline of the construction of a mass analyzer which is an embodiment of the present invention.

The principal function of each section is as indicated in FIG. 3 and the detail thereof is as follows. That is, the plasma generating section consists of e.g. a microwave plasma torch 11 and makes plasma 70 absorb microwave power by means of a coaxial helical coil 21. At this time, when e.g. Ar is used as the plasma gas 51, a doughnut-shaped argon plasma is generated e.g. in the atmosphere and a sample (e.g. K, Ca, etc.) is introduced from a nebulizer into the center thereof together with carrier gas (Ar in this case). They are ionized together with the plasma gas through vaporization →atomization→ionization (generation of the plasma 70 containing ions such as $Ar^+$, $K^+$, $Ca^+$, etc.).

The center part of this plasma 70 is diffused into a moderate pressure ($10^2-1$ Pa) region through the orifice 81 (diameter of about 0.5–2 mm) formed in the plasma sampling electrode (usually at ground potential) 80 to produce a diffused plasma 71. The ion extraction electrode 90 having the orifice a1 (diameter of about 0.3–1.5 mm) is disposed touching this diffused plasma 71. The ion acceleration electrode 100 having the orifice 101 (diameter of about 0.1–1 mm) is disposed therebehind (gap of about 0.3–1.3 mm), with respect to which the ion extraction voltage $V_E$ is applied to the ion extraction electrode 90. At this time, an ion sheath is formed in the neighborhood of the orifice 91 in the ion extraction electrode 90 and ions (e.g. $Ar^+$, $K^+$, $Ca^+$ ions, etc., described above) are extracted from the diffused plasma 71 stated above, which ions form an ion beam 200.

This ion beam 200 is converged by the ion lens system 110 and introduced into the charge exchange reaction cell 120. The reaction gas (which is Ar gas in the case of this example) is introduced into this charge exchange reaction cell 120 ($10^{-3}-7\times10^3$ Pa) and principally the resonance charge exchange reaction takes place (fast $Ar^+$ ion + slow Ar atom→fast Ar atom + slow $Ar^+$ ion) Fast Ar atoms and slow $Ar^+$ ions produced by the resonance charge exchange reaction stated above as well as the fast ions such as $K^+$ ions, $Ca^+$ ions, etc., which are almost not subjected to the charge exchange reaction, are introduced into the energy analyzer 150 (on the inner surface of which an electrically conductive black film is formed) through the slit 140.

The fast Ar atoms, $K^+$ ions, $Ca^+$ ions, etc. as well as the slow $Ar^+$ ions are deflected by the deflection voltage $V_O$ applied between the inner and the outer electrode in the energy analyzer 150 except for the neutral fast Ar atoms. When the deflection voltage $V_O$ stated above is set up so that the fast $K^+$ ions, $Ca^+$ ions, etc. just pass through this energy analyzer 150, the slow $Ar^+$ ions are strongly deflected and collide with the inner electrode etc. of the energy analyzer 150 stated above and are extinguished (thus removing disturbing ions).

In a 90° deflection type electrostatic energy analyzer as indicated in FIGS. 1 and 3 there is a relationship $E=V_O/2 \ln(r_2/r_1)$ between the energy E of the incident ions and the voltage $V_O$ applied between the two deflection electrodes. If they are so designed that the radius of curvature of the inner deflection electrode $r_1=5.7$ cm and the radius of curvature of the outer deflection electrode $r_2=6.3$ cm, $E_O=5.0\ V_O$ On the other hand, the fast neutral Ar atoms are not deflected and go straight on (in the direction of the incident beam) through the orifice 151 formed in the outer electrode of the energy analyzer 150 described above to be monitored by a detector 171.

The ion beam consisting of the fast $K^+$, $Ca^+$ ions, etc., which have passed through the energy analyzer 150 is introduced into the mass analyzer 160 (quadrupole type, etc.) to be mass-analyzed and detected by the detector 170. The electronic circuit used is so constructed that detection signals thus obtained are subjected to data processing by means of a computer such as a personal computer to obtain necessary information.

Although in the above embodiment, plasma generation by microwave discharge has been described, it may be produced by high frequency discharge, corona discharge, DC glow discharge, etc. Further, the method for extracting ions from the plasma is not restricted to that described in the above embodiment, but any ion extraction method may be used. Still, further the energy analyzer 150 is not restricted to the 90° deflection type electrostatic energy analyzer, but any type of energy analyzer, such as a parallel plate type may be used, if energy analysis can be performed therewith, i.e. if slow ions can be cut off therewith.

Still further, it is obvious that the idea of the present invention can be applied to a neutral beam (such as a fast A atom beam described above) generating device.

Since the mass analyzer according to the present invention consists of at least a charge exchange cell 120 and the energy analyzer 150 as explained above, the following effects can be obtained. That is, the charge exchange cell 120 has a function of transforming fast disturbing ions into fast neutral atoms or molecules and slow disturbing ions by the resonance charge exchange reaction of incident fast ions with a reaction gas. On the other hand, the energy analyzer 150 has a function of selecting and separating the fast neutral atoms or molecules and the slow disturbing ions from the fast ions of trace elements. Consequently, by the construction according to the present invention, a large effect can be obtained that it is possible to selectively separate plasma gas ions (e.g. $Ar^+$) and isobaric element ions ($K^+$, $Ca^+$, $Fe^+$, etc.) and thus reduce interference therebetween, and therefore quantitative measurement can be performed with a high sensitivity.

Still further, the charge exchange reaction cell has an effect of absorbing photons radiated by the plasma. Therefore, it is possible to converge the ion beam with a higher efficiency than a prior art photon stopper and to intend to increase the sensitivity. In addition, by blackening the inner surface of the energy analyzer stated above or by disposing an aperture 151 in the beam incident direction, it becomes possible to increase further the sensitivity, to improve the S/N ratio and to lower the detection limit, and the property of the present device is further improved

What is claimed is:

1. A plasma ion source mass spectrometer for trace elements comprising:

a plasma generating section;
an ion beam generating section;
an ion beam focusing section;
an ion mass analyzer section;
an ion detector section;
a charge exchange reaction section; and
an ion energy analyzer section, the last two sections being disposed between said ion beam focusing section and said ion mass analyzer section.

2. A plasma ion source mass spectrometer for trace elements according to claim 1, wherein plasma gas introduced into said plasma generating section and reaction gas are of the same kind.

3. A plasma ion source mass spectrometer for trace elements according to claim 2, wherein argon, nitrogen, or helium are used for said plasma gas and said reaction gas.

4. A plasma ion source mass spectrometer for trace elements according to claim 1, wherein a 90° deflection type electrostatic energy analyzer is used as an ion energy analyzer in said ion energy analyzer section.

5. A plasma ion source mass spectrometer for trace elements according to claim 4, wherein an orifice is formed in an outer deflection electrode of said 90° deflection type electrostatic energy analyzer at the position, which is on an extension of a beam incident direction.

6. A plasma ion source mass spectrometer for trace elements according to claim 4, wherein an electrically conductive black material is applied on inner surfaces of inner and outer electrodes of said 90° deflection type electrostatic energy analyzer.

7. A plasma ion source mass spectrometer for trace elements according to claim 1, wherein the charge exchange reaction section enables a charge exchange reaction in which fast charged particles are transformed into fast neutral particles, and slow neutral particles are transformed into slow charged particles.

8. A plasma ion source mass spectrometer for trace elements according to claim 7, wherein the fast charged particles are fast positive ions, the fast neutral particles are fast neutral atoms or molecules, the slow neutral particles are slow neutral atoms or molecules, and the slow charged particles are slow positive ions.

9. A plasma ion source mass spectrometer for trace elements according to claim 7, wherein the ion energy analyzer section enables the fast neutral particles to pass out of the spectrometer, and strongly deflects and extinguishes the slow charged particles, thereby reducing interference due to peaks in measurements made with the spectrometer caused by the fast charged particles.

10. A plasma ion source mass spectrometer for trace elements, comprising:

plasma generating means for generating plasma from a plasma gas;
plasma gas introducing means for introducing the plasma gas into the plasma generating means;
sample introducing means for introducing a sample into the plasma;
ion beam generating mean for generating an ion beam from ions in the plasma;
ion beam focusing means for focusing the ion beam generated by the ion beam generating means;
charge exchange reaction means for enabling a charge exchange reaction between ions in the focused ion beam and a reaction gas;
ion energy analyzer means for energy-analyzing ions in the focused ion beam after the focused ion beam has passed through the charge exchange reaction means;
ion mass analyzer means for mass-analyzing the energyanalyzed ions; and
ion detector means for detecting the mass-analyzed ions.

11. A plasma ion source mass spectrometer for trace elements according to claim 10, wherein the plasma gas and the reaction gas are the same kind of gas.

12. A plasma ion source mass spectrometer for trace elements according to claim 11, wherein the plasma gas and the reaction gas are argon, nitrogen, or helium.

13. A plasma ion source mass spectrometer for trace elements according to claim 10, wherein the ion energy analyzer means comprises a 90° deflection type electrostatic energy analyzer.

14. A plasma ion source mass spectrometer for trace elements according to claim 13, wherein the 90° deflection type electrostatic energy analyzer comprises an outer deflection electrode having an orifice formed therein at a point intersected by a line extending in a direction at which the focused ion beam is incident to the 90° deflection type electrostatic energy analyzer.

15. A plasma ion source mass spectrometer for trace elements according to claim 13, wherein the 90° deflection type electrostatic energy analyzer comprises an inner electrode, an outer electrode, and an electrically conductive black material disposed on an inner surface of the inner electrode and an inner surface of the outer electrode.

16. A plasma ion source mass spectrometer for trace elements according to claim 10, wherein the charge exchange reaction means enables a charge exchange reaction in which fast charged particles from the focused ion beam are transformed into fast neutral particles, and slow neutral particles from the reaction gas are transformed into slow charged particles.

17. A plasma ion source mass spectrometer for trace elements according to claim 16, wherein the fast charged particles are fast positive ions, the fast neutral particles are fast neutral atoms or molecules, the slow neutral particles are slow neutral atoms or molecules, and the slow charged particles are slow positive ions.

18. A plasma ion source mass spectrometer for trace elements according to claim 16, wherein the ion energy analyzer means enables the fast neutral particles to pass out of the spectrometer, and strongly deflects and extinguishes the slow charged particles, thereby reducing interference due to peaks in measurements made with the spectrometer caused by the fast charged particles.

* * * * *